United States Patent [19]

Heath

[11] 4,229,236

[45] Oct. 21, 1980

[54] PROCESS AND APPARATUS FOR HEAT TREATING STEEL USING INFRARED RADIATION

[75] Inventor: James E. Heath, Mississauga, Canada

[73] Assignee: Samuel Strapping Systems Limited, Mississauga, Canada

[21] Appl. No.: 61,471

[22] Filed: Jul. 27, 1979

[51] Int. Cl.[2] ..... C21D 1/54

[52] U.S. Cl. ..... 148/128; 148/153; 148/156

[58] Field of Search ..... 148/128, 153, 156

[56] References Cited

U.S. PATENT DOCUMENTS

| | | | |
|---|---|---|---|
| 3,496,033 | 2/1970 | Gilbreath | 148/128 |
| 3,708,354 | 1/1973 | Rowell | 148/128 |

*Primary Examiner*—P. D. Rosenberg

[57] ABSTRACT

Process and apparatus for stress relieving steel sheet, strip, strapping, wire and the like involves the use of high intensity shortwave infrared radiation to heat the steel to the desired stress relieve temperature. The apparatus comprises a furnace having opposing spaced-apart parallel banks of infrared radiation lamps. An electronic programmable controller controls the intensity of the lamps along the banks' length. A roller arrangement is used in passing such steel through the furnace. A device measures the linear speed of the steel. The controller adjusts lamp intensity, as determined by a program based on the signal received from the line speed measuring device. The controller, according to its program, maintains a minimum lamp intensity when the steel is stationary. The controller increases the lamp intensity to a predetermined level to preheat the steel to ensure on line start-up that the steel emerges at the desired stress relieve temperature. The responsiveness of the infrared heating unit provides significant advances in the art of stress relieving steel and economines.

10 Claims, 5 Drawing Figures

PROCESS AND APPARATUS FOR HEAT TREATING STEEL USING INFRARED RADIATION

FIELD OF THE INVENTION

This invention relates to process and apparatus for stress relieving steel by the use of high intensity shortwave, infrared radiation.

BACKGROUND OF THE INVENTION

The common approach for stress relieving steel in the form of sheet, strip, strapping, wire and the like is to pass the length of steel through a gas-fired or induction furnace which heats the steel as it passes through the furnace to the desired stress relieve temperature. The steel, as it exits from the furnace, is cooled according to various known techniques to achieve the desired properties in the stress relieved steel. Very substantial capital investment is needed to provide a gas-fired furnace of the size which is capable of treating steel sheet and the like. Substantial floor area is needed for such equipment. Another significant problem with a gas-fired furnace is its inability to immediately adjust to changing temperature requirements for stress relieving. Substantial periods of time are needed to bring the furnace up to the desired temperature for stress relieving a particular steel and to adjust that temperature requires additional extended times. Another difficulty with the use of gas-fired furnaces is that the temperature is set for a particular line speed. Should that speed vary, there is thus a change in the temperature to which the steel is elevated. Thus, there are frequent inconsistencies in the characteristics of the gas-fired furnace stress relieved product.

A further requirement in the use of gas-fired furnaces to continuously heat treat steel sheet and the like is to use accumulators. Such a system is disclosed in Canadian Pat. No. 661,066, where although the system is used for making high tensile strap, it demonstrates the use of accumulators in combination with a gas-fired furnace to manufacture strapping. The use of accumulators requires substantial floor area in the plant and also high capital investment in setting up the operation.

In instances where it is desired to stress relieve coiled steel sheet, strip, strapping, wire and the like, instead of uncoiling the steel and passing it through a gas-fired furnace and recoiling it, attempts have been made to heat treat the coil on a bulk basis, which is commonly referred to as "box" stress relieving of coils. Aside from overcoming the internal distortion aspects, an extended period of time is needed to stress relieve the product such as up to three days or more of heat treating. A further drawback with "box" stress relieving is the inconsistencies in the characteristics of the stress relieved steel in the particular coil.

Various attempts have been made to heat metals using infrared radiation. Heat treatment has been on a batch basis where a portion of the metal, such as steel or aluminium, is exposed to infrared radiation to heat the metal. For example, aluminium may be preheated to a desired temperature prior to forming 90° bends in the aluminium by using a break press. Such infrared heaters may be purchased from Barry & Sewell of Minneapolis, Minn.

I have discovered process and apparatus using high intensity infrared heating units which may be adapted to stress relieve steel sheet, strip, strapping, wire and the like for heating it to a stress relieve temperature. A significant problem encountered in developing the use of high intensity infrared radiation for stress relieving steel sheet and the like was that the high power inputs necessary to heat the sheet caused a significant percentage of burn-out of the radiation emitter lamps. This problem has been overcome by controlling the temperature of the lamp electrodes during use in heat treating steel at high linear speeds.

It is, therefore, an object of the invention to stress relieve steel sheet, strip, strapping, wire and the like using high intensity infrared radiation.

It is a feature of the invention to stress relieve such steel in using high intensity shortwave, infrared radiation heaters to obtain precise control on the consistent heating of the steel to the desired stress relieve temperature and the ability to adjust the intensity of the radiation, dependent upon line speed, so that consistent temperatures for stress relieving steel are maintained.

It is, therefore, an advantage of this invention to provide an apparatus which is adapted to stress relieve types of steel where substantially lower capital costs are needed to heat the steel.

It is another advantage of the invention that the line may be started and stopped at will without causing damage to the steel, because the intensity of the infrared radiation may be adjusted almost instantaneously dependent upon detected change in speed of the steel passing through the unit.

It is another advantage of the invention that precise control can always be maintained on heat treating steel and that lighter gauges of steels may be stress relieved using this process.

A further advantage of the invention is an option to eliminate accumulators in view of the start/stop feature of the invention.

SUMMARY OF THE INVENTION

The process according to this invention for stress relieving steel sheet, strip, strapping, wire and the like comprises passing such steel between a length of opposing parallel, spaced-apart banks of high intensity infrared radiation lamps. The linear speed of the steel may be measured by electrical device which generates a signal representative of the measured speed. The intensity of the lamps may be electronically controlled along the banks' length. The controlling of the intensity is dependent upon signal input to proportionately vary the intensity of the lamps based on the measured line speed. This ensures a consistent heating of such steel to a desired stress relieve temperature as it emerges from the banks. The emerging steel is cooled to give a desired stress relieve product. A minimum lamp intensity is maintained when the steel is stationary between the banks. Before start-up of passing such steel between banks, the intensity of the lamps is increased to a predetermined level to preheat the steel to ensure on start-up that the steel emerges at the desired stress relieve temperature. Subsequently, the intensity of the lamps is controlled by the electronic controller.

Apparatus, in which this process is implemented, comprises a furnace having lengths of opposing spaced-apart, parallel banks of infrared radiation lamps. An electronic programmable controller is provided for controlling the intensity of the lamps along the banks' length. A roller arrangement is provided for passing the steel through the furnace. A device measures the speed of the steel as it passes through the tower and generates a signal representative of the measured line speed. Means is provided for transmitting the signal to the controller. The controller adjusts the lamp intensity as determined by a program based on the received signal. The controller, according to its program, maintains a minimum lamp intensity when the steel is stationary and for line start-up, increases the lamp intensity to a predetermined level to preheat the steel to ensure on start-up that the steel emerges at the desired stress relieve temperature. Means is provided for cooling the steel as it emerges from the banks to give the desired stress relieved product.

According to a preferred aspect of the invention, the furnace, as adapted for use in stress relieving steel sheet and the like, comprises opposing spaced-apart, parallel banks of high intensity infrared radiation emitters having ceramic collectors behind the emitters and along the banks. Each emitter is an elongate lamp having an electrode at each end. Opposing spaced-apart suitable supports are secured within the furnace and are provided with aligned apertures to permit lamp ends to extend through such apertures as they are supported in a respective bank.

Each lamp electrode is external of a corresponding support. Means defines a channel along the outside of each support and in which said lamp electrodes are disposed. Fan means is provided for forcing sufficient air through each channel to maintain the lamp electrodes at operating temperatures and thereby avoid the significant previously mentioned problem of lamp burn-out.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
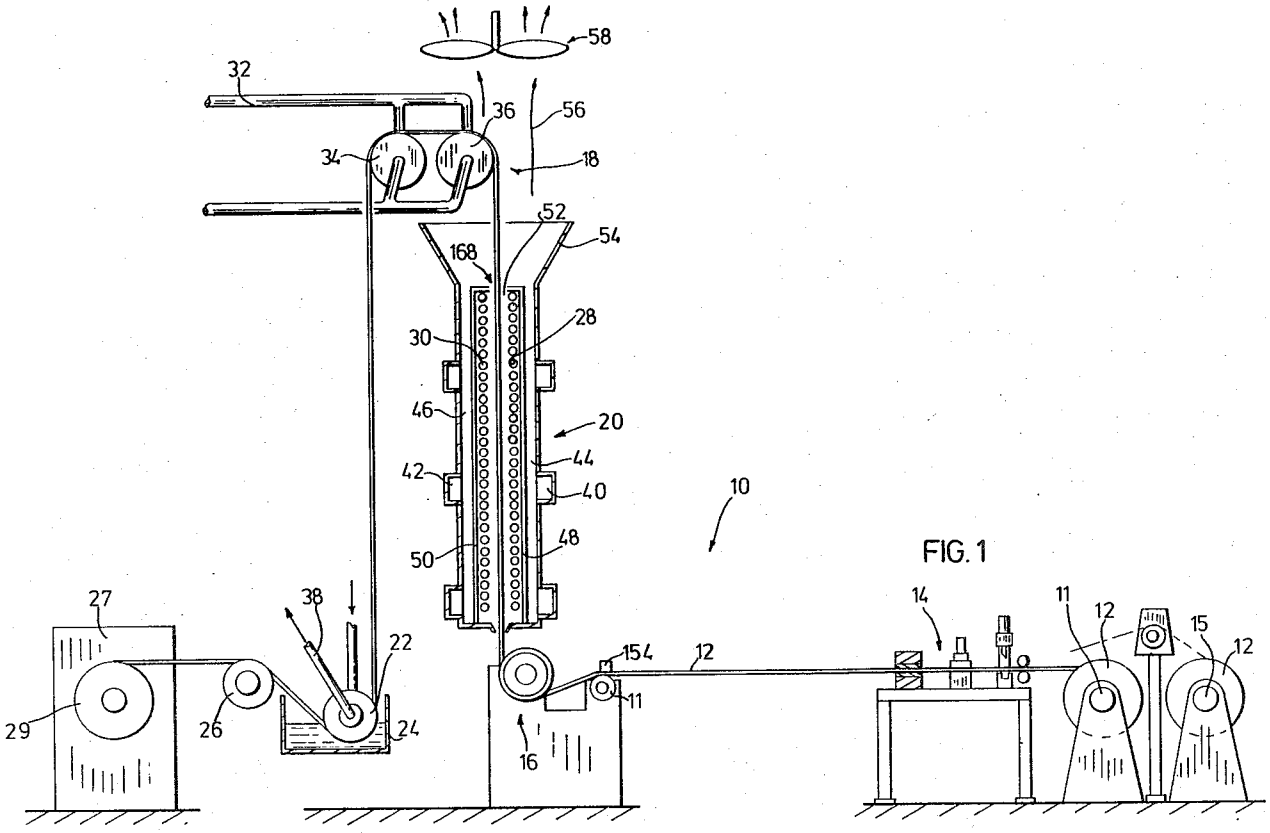
FIG. 1 is a schematic of apparatus for stress relieving coiled sheet.

The apparatus of the stress relieving line generally designated 10 is adapted, according to this embodiment, to stress relieve coiled steel sheet. A pay-off reel 11 has coiled sheet 12 which is fed through a joint welding device 14. An additional pay-out reel 15 has another coil of steel sheet 12. The joint welding device 14 is used to connect the end of the sheet from pay-out reel 11 to the beginning of the sheet from pay-out reel 15, thus reducing the time needed to join the coils of material when it is desired to heat treat several similar coils. By way of the roller arrangements 16 and 18, the steel sheet 12 is passed upwardly through the heat treating furnace 20. The sheet 12 is returned downwardly to roller 22 which passes the heated sheet 12 through a cooling bath 24. The sheet 12 emerges from the cooling bath 24 and by roller 26 is passed to sheet recoiling device 27. The sheet is recoiled on coiling spool 29. The drive for the coiling spool 29 pulls the sheet through the line and thus the speed at which the recoiler 27 is driven determines the speed at which the steel sheet passes through the furnace 20. Instead of recoiling the sheet, it may at that time be passed to a slitting device to slit the sheet into desired strapping or strip sizes and optionally edge conditioned and painted before recoiling.

The furnace 20 comprises opposing banks 28 and 30 of high intensity infrared radiation emitters. The emitters may be of the tungsten filament quartz tube body type. These may be obtained from various manufacturers and distributors, such as Barry & Sewell of Minneapolis. The infrared radiation emitted by such lamps, when electrically powered, is shortwave. The wavelength ranges from approximately 0.76 microns to 5 microns. The energy distribution of such lamps reaches a peak energy of approximately 1.15 microns. The shortwave infrared radiation is transmitted directly to the strapping without heating the surrounding air. The radiation quickly penetrates the steel to heat it from the inside out. Depending upon the intensity of the radiation emitted by the lamps, the steel sheet, as it passes through the furnace, may be heated to any desired stress relieve temperature. Factors to consider in setting the intensity of the lamps are:

(1) the speed at which the sheet passes through the tower;

(2) the composition of the steel sheet;

(3) the distance between the emitter banks 28 and 30;

(4) the thickness and width of the steel sheet; and (5) the desired temperature to which the steel must be elevated to achieve the desired physical characteristics for a stress relieve product.

It has been found that the lamps respond very quickly in varying the intensity of radiation emitted by varying the electrical power applied to the lamps. Thus, it is possible to vary the intensity of the lamps dependent upon the line speed to maintain a constant stress relieved temperature for the steel sheet. Such fast temperature response provides far superior control on stress relieving steel sheet compared to gas-fired or induction furnace heating, because of the precision in controlling the temperature to which the steel is heated to yield a product with consistent physical properties.

As explained, it is necessary to use accumulators with prior art gas-fired furnaces in order to maintain a passage of steel through the furnace to avoid damage to the heat treated steel. With the apparatus and process of this invention, in view of its very quick response time, it is possible to eliminate the need of the costly accumulators, because the line can be started and stopped at will by providing a controller which adjusts the intensity of the lamps dependent upon the line speed. The start/stop feature of this invention is also important with respect to the connecting of one coil to another. Joints between sheet may be made at will and the line restarted. When it is desired to remove the welded joint from the coil, after it has been passed through the furnace, it is possible to stop the line when the joint reaches the recoiler 27, remove the joint and subsequently start up the line again to heat treat the new coil of steel.

Figure 2:
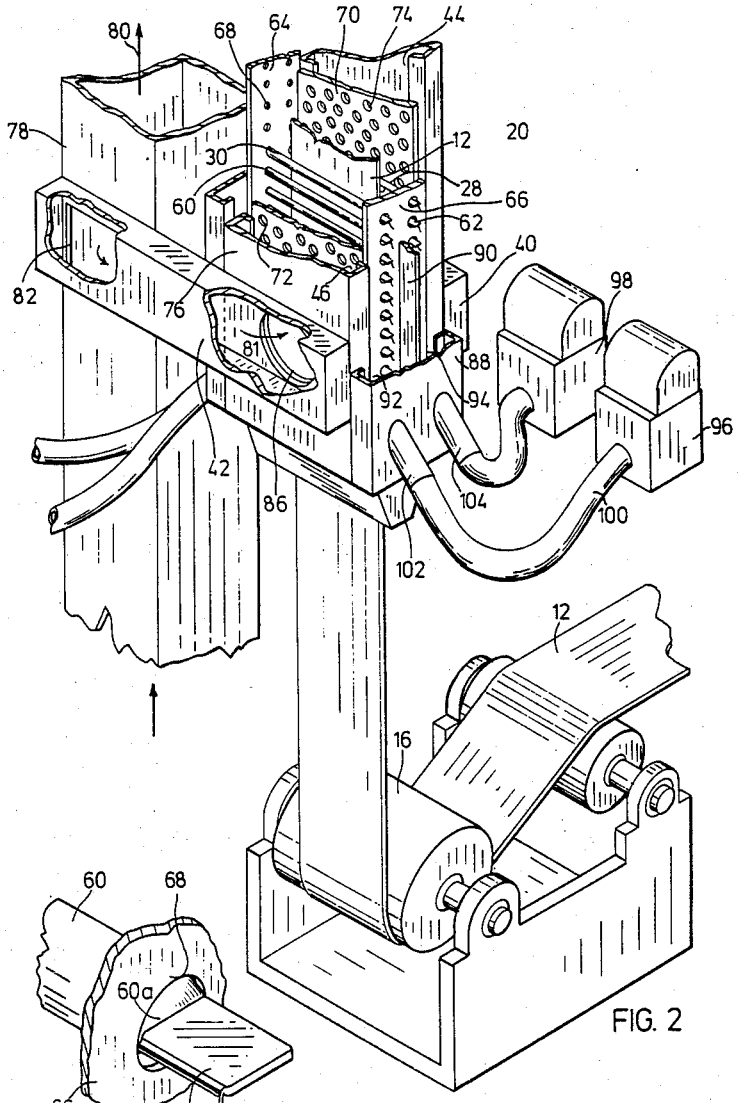
FIG. 2 is a view showing in more detail structural aspects of the furnace lower portion.

The roller device 18 is provided with cooling lines 32 to cool the individual rollers 34 and 36. Depending upon the properties desired in the stress relieved steel sheet, a selected amount of cooling may be provided in rollers 34 and 36. In instances where no cooling is desired, then the amount of refrigerant passing through lines 32 may be reduced to the extent to keep the rollers at a desired operating temperature to avoid damage to the roller by overheating. The steel sheet is passed through final cooling bath 24, where roller 22 is cooled by refrigerant in line 38. Again the temperature, at which the bath 24 is held, depends upon the properties desired in the stress relieve sheet. Water may be used in bath 24 for controlling the cooling of the steel before recoiling The furnace 20 may be provided with various forms of forced-air devices to cool the lamp electrodes and to provide a flow of air up to the centre of the furnace. As shown in FIG. 1, ducks 40 and 42 supply forced-air to plenums or channels 44, 46 alongside the rear of the ceramic reflectors 48 and 50 of the emitter banks 28 and 30. The ceramic reflectors 48 and 50 may include a plurality of openings, such as shown in FIG. 2, to permit air, as it passes upwardly along channels 44, 46 to permeate through the openings, pass over the emitter banks 28 and 30 and upwardly through the central area 52 of the furnace. The air emerging from the furnace into the funnel portion 54 is exhausted in direction of arrows 56, by a fan schematically represented at 58.

Figure 3:
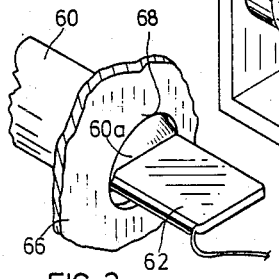
FIG. 3 is an enlarged view of the mounting of an end of an infrared lamp on a ceramic support.

Referring to FIG. 2, further detail of the forced-air arrangements for the tower and the lamp supports is shown. The steel sheet 12 is fed upwardly into the furnace 20 by the lower roller device 16. The relationship of the sheet 12 to the emitter banks 28 and 30 is shown. Each bank in furnace 20 is made up of a plurality of horizontally spaced-apart emitter lamps 60 which, according to this embodiment, are elongate, thin, tubular lamps having end electrodes 62. Suitable supports 64 and 66 are secured to the furnace structure. They are spaced-apart and oppose one another with horizontally aligned apertures 68. The horizontally aligned apertures 68 support lamp ends as shown in more detail in FIG. 3. Support 66, with opening 68, supports the lamp 60 as its end portion **60*a* with the electrode 62 projecting exteriorly of the support 66**. According to this embodiment, the support material may be ceramic.

Behind and extending along the furnace are spaced-apart ceramic reflectors 70 and 72. According to this embodiment, the reflectors include a plurality of openings 74 which, as mentioned, permit the air, as flowing upwardly in channels 46 and 44, to permeate through the openings, pass over the lamps 60 and provide a flow upwardly of air in channel 52. The passage of air over the lamps provides cooling for the ceramic reflectors 70, 72. The channels 44, 46 are defined on the outside by fabricated sheet metal 76 which is secured to the furnace frame. The ducts 40 and 42 supply air to the channels 44, 46 at three different locations along the height of the furnace. Each duct 40 and 42 is connected to a common main duct 78 which carries the main flow of air in the direction of arrow 80. Duct 42 is in communication with the main duct 78 by opening 82. Deflectors (not shown) are used to direct a portion of the air from the main duct into the branch duct 42 which is forced into channel 46 in the direction of arrow 84 through opening 96. A similar arrangement for the remaining branch ducts is provided.

In operating the high intensity infrared radiation lamps at high outputs in order to achieve stress relieving of the steel sheet 12, there was a significant problem with lamp burnout. I discovered that this problem can be overcome by cooling the lamp electrodes as they are positioned just exterior of the support ceramic 66. Outside of the ceramic support 66, is a length of formed sheet metal 88 which defines a channel. In this embodiment, a partition 90 separates the so-formed channel into portions 92 and 94. Although not shown, the lamp electrodes 62 are electrically connected to a bus-bar to supply voltage to the lamp electrodes. The bus-bar may be located on each side of the partition 90.

A supply of forced air is provided to each channel portion 92, 94 by independent fans 96 and 98 which, by flexible ducting 100, are connected to upwardly sloped entrance nozzles 102 and 104 which direct the flow of air upwardly over the lamp electrodes 62.

Figure 4:
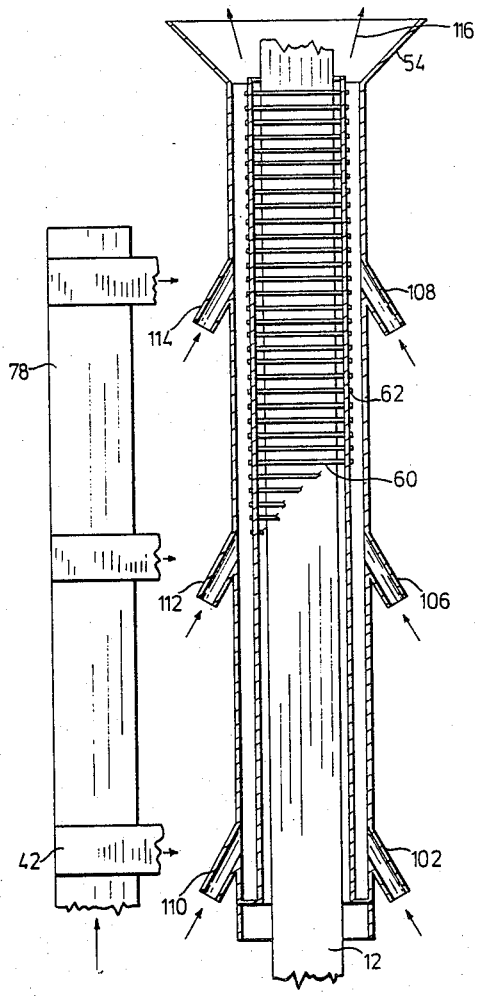
FIG. 4 is an elevation of the furnace of FIG. 1 showing lamp electrode cooling.

As shown in FIG. 4, there are three sets of entry ducts 102, 106 and 108 for each side of the furnace to provide cooling for each series of electrodes in the manner described with respect to FIG. 2. Similarly on the other side, additional ducts 110, 112 and 114 supply a flow of air upwardly in the channel portions to cool the lamp electrodes independently of the flow of air upwardly through the middle of the furnace. The air for cooling the lamp electrodes flows upwardly in the channel portions and exhausts into the funnel-shaped portion 54 in the direction of arrows 116. This air, along with the air emerging from the centre of the tower, is exhausted by fan 58. Also as shown in FIG. 4, the main duct 78 extends upwardly and supplies forced air to the branch ducts 42 which, as explained with respect to FIG. 2, supply the forced air to the channels 44, 46.

Figure 5:
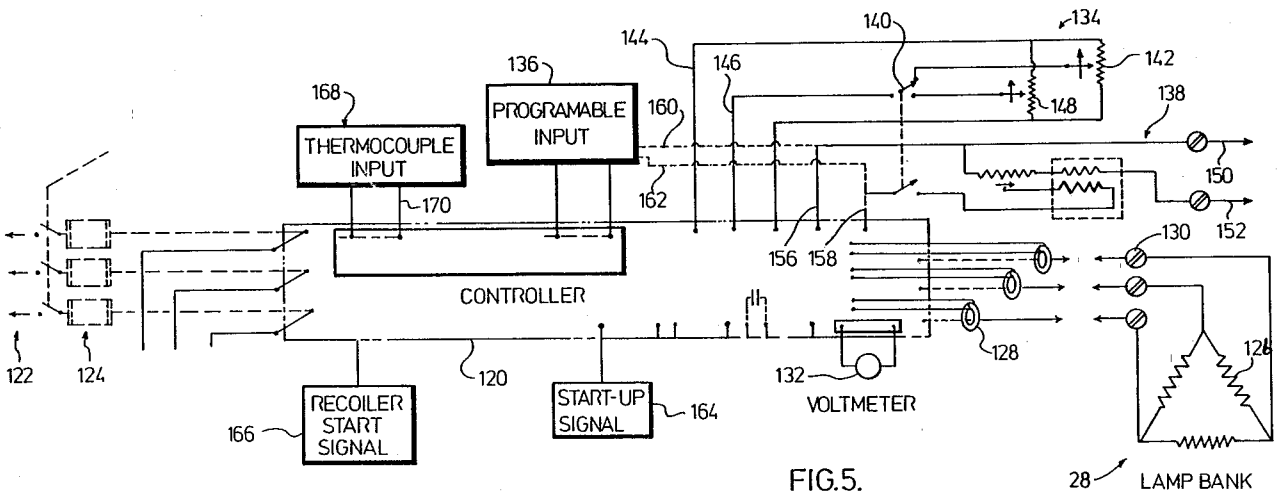
FIG. 5 is a schematic showing various aspects of the electronic controller for controlling the intensity of the infrared radiation lamps.

The manner in which the process controller controls the lamp banks is shown in more detail in FIG. 5. The controller 120 is powered by terminals 122 through fuses 124. Power to the controller may be of the magnitude of approximately 570 volts with three phase 60 hertz cycle. Power may be derived from the controller 78 to operate and control the operation of the fans supplying air to various ducts in the furnace and to power the lamps, such as lamp bank 28, which in this embodiment, is a delta load configuration. Either bank of lamps in the furnace, therefore, consists of three sets 126, which are connected in the manner shown. Another set is connected in a similar manner to provide the other bank 30 of lamps. Current sensors 128 sense the current in the lines supplying terminals 130 for lamp bank 28. A volt meter 132 is provided to display the sensed voltage in the lines leading to terminals 130.

In this embodiment, there are peripheral inputs to the controller 120, such as manual adjustment network 134, programmable input 136 and tachometer electric signal through network 138 which represents the measured line speed.

The manual adjustment for the output of the controller 120 at terminals 130 is determined by the network 134. The double-pull/double-throw switch 140 is shown in the manual intensity adjustment position. The setting of potentiometer 142 provides input to the controller 120 via lines 144, 146. Potentiometer 148 determines the intensity of the lamps when the line is stopped and steel sheet is located in the furnace. This setting is called the "idle" or "stand-by" setting for the lamp intensity by the controller 120. The "idle" setting for the furnace when the line is stopped is necessary to provide energy in the lamps, so that they may be reactivated immediately to commence increasing the radiation intensity to the desired level before line start-up. The "idle" setting is selected such that with the steel sheet stationary in the tower, the sheet temperature does not exceed a label which would cause harm to the sheet in terms of severe warping or distortion or would not significantly exceed the temperature at which the product is to be stress relieved, so that on subsequent cooling, the desired physical properties for the stress relieved product are obtained.

Input to the controller from a tachometer is fed to the network 138 via lines 150, 152. A tachometer may be located conveniently on the line 10 to detect the linear speed at which the sheet 12 is travelling. For example, a tachometer may be located at 154 at roller 17 to detect the speed at which the sheet is travelling through the furnace 20. The tachometer generates a signal corresponding to the speed at which the sheet is travelling and this signal is fed via lines 150, 152 to the network 138. The signal may then be fed directly to the controller 120 through lines 156, 158 or to the programmable input device 136 via lines 160, 162. The controller 120 may include internally a programable device which, when the switch 140 is in the other position, will control the intensity of the lamp bank 28 according to its program to provide the necessary power at terminals 130 to give the intensity needed to heat the steel sheet to the desired temeprature for a particular sensed line speed.

On the other hand, it is advantageous to provide a separate programmable input 136 which can have its program readily changed to accommodate stress relieving of various forms of steel sheet. The programmable input 136 may be of the type which has it program recorded on a chart. Such a unit may be that sold under the trademark "Data-Trak" by Barry & Sewell of Minneapolis. This device converts the signal input from the tachometer in terms of sensed line speed into a signal which causes the controller 120 of the lamp bank 28 to adjust or set lamp intensity at a level to heat the steel to the desired temperature for the particular sensed speed. Various programmed charts may be prepared to accomplish stress relieve in different types of steel sheet. Thus, the controller program can be varied easily by replacing charts to provide the desired stress relieve characteristics in each different coil to be stress relieved.

The lamp banks, as electrically powered, are, as mentioned, very responsive to change in voltage applied. Thus, with the programmable input 136 and measuring of line speed, the controller can immediately vary the intensity applied to the lamps on detecting either an increase or decrease in line speed to adjust accordingly the intensity to always obtain the same desired degree of heating in the steel sheet on its emerging from the tower. In view of the responsiveness of this unit and the measuring of the line speed in combination with the programmable aspect of the controller, a very consistent stress relieve product can be obtained over wide variations in line speed.

The preciseness in the control of the intensity of the furnace also enables the heat treating of very thin steel sheet, such as sheet of a thickness of 0.015 inches. In the past, it was very difficult to achieve heat treating of such thin steel, because in gas-fired or induction furnaces, the control was very poor and thus with the thinner steels, they were subject to quicker heating so that minor variations in line speed and furnace temperature resulted in substantial variations in the characteristics of the stress relieved product. However, with the controller, according to this invention, the program may be changed to adjust accordingly the intensity of the lamps to achieve a consistent heat treatment of thinner sheet to give constant characteristics in stress relieved product.

Restart of the line, depending upon the thickness and characteristics of the sheet, may involve preheating the sheet to a predetermined temperature so that when the sheet begins moving through the furnace, it will emerge at the desired stress relieve temperature. While the sheet is stationary in the furnace, the potentiometer 142 determines the "idle" setting for the lamps. On the controller 120 receiving a start-up signal from unit 164, the controller may include a hard wired program or access the programmable input 136 to determine the needed intensity in the lamp banks 28 and 30 to raise the temperature of the sheet to a proper temperature before start-up, so that when the sheet emerges from the tower, it is at the proper temperature. Depending upon the makeup of the steel sheet, its thickness and the speed at which it is to be processed, the lamp bank 28, 30, as positioned in the delta load configuration, may have its upper section increased to an intensity greater than the lower sections and then the sections balanced as the line begins to move, so that the upper section is heated the most before line movement, thus ensuring that the upper portion of the sheet in the furnace emerges at the required temperature. The controller may be adapted to provide a signal at output 166 to energize the recoiler 27 to commence drawing the sheet through the furnace after the sheet has been preheated to the desired temperature. At this point, the recoiler can be accelerated to the desired line speed where the controller determines lamp intensity to achieve the desired stress relieve temperatures in the emerging steel sheet.

Although the programmable input 136 may be programmed to adjust the intensity of the lamps according to the particular steel sheet to be treated, there may be slight variations in the sheet thickness which can result in variation in the temperature of the sheet as it emerges from the tower, due to the manner in which the infrared radiation heats the sheet. For some steel sheet chemistries, the sheet should be stress relieved at a temperature of 1050° F. plus or minus 20° F. It may be with varying sheet thickness that the temperature of the sheet for the intensity set by the programmable input 126 produces temperatures outside of the acceptable range. To overcome this difficulty, a thermocouple device may be located at 168 to measure the temperature of the sheet as it emerges from the tower. The thermocouple may be adapted to provide an electric signal which is input to the controller via lines 170. The controller may be adapted to permit input from the thermocouple unit giving a signal representative of the sheet temperature to override the programmable input and adjust the intensity of the lamps to accommodate minor changes in temperature of the sheet. Thus, the controller is set up, in this embodiment, to control precisely the temperature of the sheet to keep it within the range specified for the stress relieve. As appreciated of course, should the temperature of the sheet vary quickly as a result in a speed-up or slowdown of the line, or stoppage of the line, then the controller may be adapted to only permit the program to determine the lamp intensity. Thus, the thermocouple device would only be used in varying intensity of the lamps for minor changes in temperature due to, for example, changes in thickness of the sheet as it is being processed.

It will be understood that depending upon the desired manner of cooling the stress relieved sheet or the like, the tower or furnace orientation may be different from that shown. For example, when it is desired to immediately quench the steel sheet on leaving the tower, it may be oriented in a horizontal manner where roller devices, including tension bridles, are located at each end of the furnace to ensure that the steel sheet does not contact the lamps. It is understood, of course, that protecting bars may be located to prevent slack steel sheet from contacting the lamps.

It is also understood that, with the apparatus of the invention, in instances of treating strapping, wire and the like which is relatively narrow compared to the other steel products, roller devices may be used which have grooves or the like to prevent the strapping or wire overlapping during its travel through the tower and subsequent cooling devices.

Thus, the use of high intensity electrically powered infrared radiation emitter banks with its quick response is a substantial advance over prior art processes for stress relieving. This apparatus considerably reduces the capital investment needed to provide a stress relieve line, while achieving unexpectedly substantial increases in the preciseness with which the band is stress relieved to thereby increase the quality of the stress relieved product. In addition, the apparatus involving the use of the compact high intensity infrared emitters requires considerably less floor area to set up the line and since the tower can be oriented vertically, further reduces the need for floor space. In addition, the unit eliminates the need for accumulators thereby reducing further the capital investment in establishing a heat treating line. However, it is understood that, in instances where an established line has accumulators, this form of stress relieving furnace may be incorporated with such lines to work in combination with the accumulators should it be so desired.

Depending upon the intensities which can be achieved within the furnace, various line speeds may be used to stress relieve steel sheet, strapping and the like. With a sufficiently large furnace, speeds of up to approximately 300 feet per minute or more may be achieved in stress relieving strapping and sheet and, at the same time, provide consistency in the characteristics of the stress relieved product.

The following examples demonstrate the utility of the process, but are in no way to be interpreted as limiting the scope of the claims of this invention.

EXAMPLE 1

A coil of steel sheet having an average thickness of 0.025 inches and a width of 12 inches was stress relieved in the furnace according to a preferred embodiment of this invention. The sheet was passed through the furnace at 75 feet per minute.

The analysis of the sheet before treatment for a 1¼ inch strip of the sheet having a thickness of 0.035 had a break strength of approximately 6,500 pounds and substantially no elongation. On treating this sheet in the furnace to stress relieve the sheet, it was raised to a temperature of 1050° F. in the furnace with subsequent cooling. The characteristics of the sheet, as analyzed for 1¼ inch width of the sheet, were a break strength ranging from approximately 6,200 pounds to 6,400 pounds and an elongation in the range of approximately 7 to 8%.

EXAMPLE 2

The same procedure of Example 1 was carried out with ¾ inch strapping of 0.035 inch thickness. The strapping had original analysis of break strength ranging from 2,650 pounds to 2,710 pounds and elongation in the range of 1%. The strapping was passed through the furnace and elevated to a temperature of 1050° F. with subsequent cooling at speeds of 75 feet per minute to yield a strapping having a break strength in the range of 2,080 up to 2,300 pounds with an elongation of approximately 6 to 7%.

These test results demonstrate that the use of the high intensity infrared radiation is capable of stress relieving steel sheet and the like without appreciably reducing the break strength of the product, yet obtaining the substantial increase in the elongation of the product. It is appreciated that the sheet may be slit into various widths and used as strapping for binding various materials to be transported. With the capability of treating the thinner sheets, it is now possible to provide a stress relieve steel strapping of the thinner dimensions to meet the demands of consumers now using heavier strapping where the lighter gauge is all that is needed.

Although various embodiments of the invention have been described herein in detail, it will be appreciated by those skilled in the art that variations may be made thereto without departing from the spirit of the invention and the scope of the appended claims.

The embodiments of the invention in which a exclusive property of privilege is claimed are defined as follows:

1. A furnace adapted for use in stress relieving a length of steel sheet, strip, strapping, wire and the like comprising opposing spaced-apart parallel banks of high intensity infrared radiation emitters having ceramic reflectors along said banks and located behind said emitters, each emitter being an elongate lamp having an electrode at each end, opposing spaced-apart suitable supports secured within said furnace and provided with aligned apertures to permit said lamp ends to extend through such apertures in supporting each lamp in a respective bank, each lamp electrode being external of a corresponding support, means defining a channel along the outside of each support and in which said lamp electrodes are disposed and fan means for forcing sufficient air through each channel to maintain said lamp electrodes at operating temperatures.

2. A furnace of claim 1, wherein said lamp supports are ceramic.

3. A furnace of claim 2, wherein said ceramic reflectors are provided with a plurality of openings, means providing a flow of air along the outside of said reflectors, where air passes through said openings and over said lamps.

4. A furnace of claim 1, wherein in each of said channels electrically conductive members are provided along said support and to which the lamp electrodes are electrically connected, a partition dividing said channel into two portions, said fan means providing a flow of cooling air in both portions of said channel.

5. A furnace of claim 3, wherein a series of fans spaced along each channel portion supply forced air for that channel portion.

6. A furnace of claim 3, wherein said furnace is oriented vertically.

7. A furnace of claims 2, 4, or 5, wherein an exhaust fan is located at exit of said furnace to exhaust air from said channels.

8. A furnace of claim 2, wherein each lamp is a tungsten filament with quartz body which, when powered, emits radiation at wavelengths approximately 0.76 to 5 microns with peak energy at a wavelength of approximately 1.15 microns.

9. A furnace of claim 2, for stress relieving coiled steel sheet in combination with means for uncoiling such steel, roller arrangement for passing such uncoiled steel through said furnace, means for cooling such steel as it emerges from said furnace and means for recoiling such cooled stress relieved steel.

10. A furnace of claim 9, wherein a controller controls the intensity of said lamps based on the speed at which such steel sheet travels through said furnace to consistently heat such sheet to the desired stress relieve temperature.

* * * * *